US009984700B2

(12) United States Patent
Cohen

(10) Patent No.: US 9,984,700 B2
(45) Date of Patent: May 29, 2018

(54) METHOD FOR EXEMPLARY VOICE MORPHING

(71) Applicant: SPEECH MORPHING SYSTEMS, INC., Campbell, CA (US)

(72) Inventor: Jordan Cohen, Kure Beach, NC (US)

(73) Assignee: SPEECH MORPHING SYSTEMS, INC., Campbell, CA (US)

( * ) Notice: Subject to any disclaimer, the term of this patent is extended or adjusted under 35 U.S.C. 154(b) by 0 days. days.

(21) Appl. No.: 13/673,708

(22) Filed: Nov. 9, 2012

(65) Prior Publication Data

US 2013/0311173 A1 Nov. 21, 2013

Related U.S. Application Data

(60) Provisional application No. 61/557,756, filed on Nov. 9, 2011.

(51) Int. Cl.
*G10L 13/033* (2013.01)
*G10L 21/013* (2013.01)

(52) U.S. Cl.
CPC .... *G10L 21/013* (2013.01); *G10L 2021/0135* (2013.01)

(58) Field of Classification Search
CPC ..... G10L 13/00; G10L 13/02; G10L 13/033; G10L 13/0335
USPC ..... 704/207, 250, 258, 261, 266, 278
See application file for complete search history.

(56) References Cited

U.S. PATENT DOCUMENTS

| | | | | |
|---|---|---|---|---|
| 2007/0185715 | A1* | 8/2007 | Wei et al. | 704/254 |
| 2007/0208566 | A1* | 9/2007 | En-Najjary et al. | 704/269 |
| 2009/0089063 | A1* | 4/2009 | Meng et al. | 704/270 |
| 2010/0049522 | A1* | 2/2010 | Tamura et al. | 704/264 |

* cited by examiner

*Primary Examiner* — Qi Han
(74) *Attorney, Agent, or Firm* — Sughrue Mion, PLLC

(57) ABSTRACT

A method of morphing speech from an original speaker into the speech of a second, target speaker with decomposing either speech into source and filter, and without the need to determine the formant positions by warping spectral envelops.

4 Claims, 6 Drawing Sheets

METHOD FOR EXEMPLARY VOICE MORPHING

CROSS REFERENCE TO RELATED APPLICATION

This invention claims priority to Provisional Patent Application No. 61/557,756 titled Method for First Order Morphing.

STATEMENT OF FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON COMPACT DISC

Not Applicable

BACKGROUND OF THE INVENTION

Field of the Invention

This invention relates the field of voice morphing.

Description of the Related Art

Voice morphing is the science of transforming a first person's voice into a second person's voice, or a reasonably acceptable approximation. In order to have the first or original speakers speech "sound like" the second or target speakers speech, it is important to mimic the pitch of the second speaker, and to have the spectral energy peaks of the first speaker approximately in the same place that these peaks appear in the spectrum of the second speaker. It is useful to think of speech as a "source", whether pitch or noise, and a "filter", typically made up of the resonances associated with the throat, mouth, and noise in a person. (There are alternate definitions of a filter, like those used by a parrot, or electrical filters, often described with poles, or resonances and bandwidths). In general if there is close approximation of the general pitch values and the resonance positions in the spectrum to those of a particular person, then the speech "sounds like" that person. A third variable, speaking rate, also affects how a person sounds.

Since the early days of speech coders based on LPC (Linear Predictive Coding), speech has been manipulated by changing the pitch of the signal, the "formants" of the signal, or both, made to sound like another speaker.

All of the modern systems of voice morphing require decomposition of the speech signal into a pitch or "source", and a spectrum or "filter" portion. This signal processing algorithm is well known to one skilled in the art of speech or voice morphing.

There are three inter-dependent issues that must be solved before building a voice morphing system. Firstly, it is important to develop a mathematical model to represent the speech signal so that the synthetic speech can be regenerated and prosody, i.e. rhythm, stress, etc. of speech, can be manipulated without artifacts. Secondly, the various acoustic cues which enable humans to identify speakers must be identified and extracted. Thirdly, the type of conversion function and the method of training and applying the conversion function must be decided.

This decomposition process is error prone, computationally difficult, and the reconstructions are generally only rough approximations of the speech of a particular person.

Creating an efficient and effective transformation between a first speaker and a second target speaker can be done by measuring the average pitch of each speaker, measuring the "formant positions" of speech of each speaker, and then transforming the speech of the first speaker to match both the average pitch and formant positions of the second speaker FIG. 1 is a high level flow diagram of a traditional voice morphing system. Referring to FIG. 1, At Step 110, the invention obtains the speech from a first speaker. Similarly, at Step 120, the invention obtains the speech from a second speaker. The pitch and formants of the first speaker are measured at step 130, and the formants of the second speaker are measured at step 140. At step 150 the formants and pitch of the first speaker are transformed to match the formants and pitch of the second speaker There are two equivalent processes to accomplish this task, described in FIGS. 2 and 3. The morphing algorithm requires two parameters for each speaker: the average pitch of each speaker and the formant position warping function to move formants from the first speaker to the second speaker. This can be one of many forms: The average change in the formant frequency to best match each speaker's formants, the cumulative distribution of each formant for the speech of each talker, or the cumulative distribution of the first three (or four) formants of each speaker over some corpus of speech.

Note that this process does not describe mimicking the accent of either speaker, nor does it affect other process (like word choice, unusual emphasis, idiosyncratic pronunciations, and others) that can affect the identity of a speaker. We are rather creating a framework onto which these more subtle transformations can be later applied, if required or desired.

This patent describes a non-decompositional computationally efficient method to implement voice morphing.

BRIEF SUMMARY OF THE INVENTION

The invention herein described relates to an exemplary method of morphing the speech of one person into the speech of another, i.e. to make one person sound like another. The traditional means include finding the pitch and formants of each speaker and performing a match. In this invention, the difficult task of locating formants is avoided. Rather, the spectral envelopes are matched and the spectral envelope of the first speakers voice is warped to be statistically similar to the spectral envelope of the second speakers voice.

DETAILED DESCRIPTION OF THE EMBODIMENTS

We describe the simplest implementation of voice warping here, and discuss the more sophisticated forms later.

Figure 1:
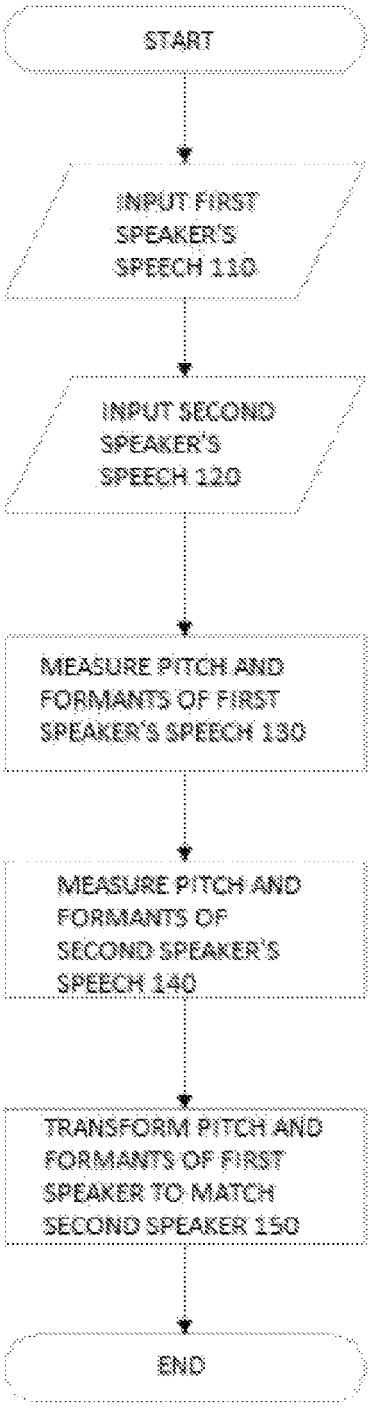
FIG. 1 (PRIOR ART)
FIG. 1 illustrates a high level flow diagram of the state of the art in voice morphing.
Figure 2:
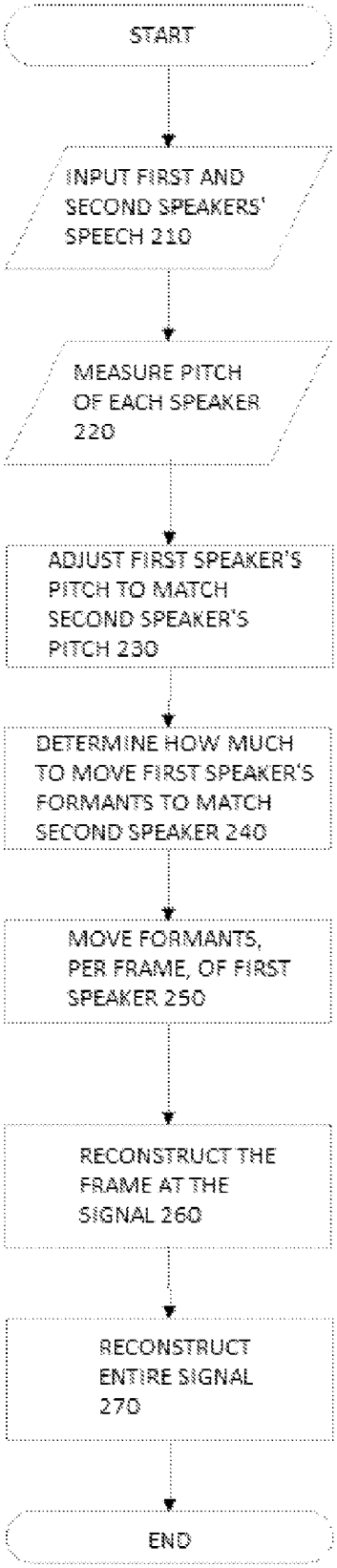
FIG. 2 illustrates a more detailed flow diagram of the state of the art in voice morphing.

FIG. 2 illustrates a high level flow diagram of a preferred embodiment of voice warping. At Step 210, the invention obtains speech from a first and second voice. At Step 220 the pitch of each speaker is measured. Pitch is measured in those voice portions of the speech. The measurement may be done in any number of ways well known to someone skilled in the art. Autocorrelation based pitch measurement, time domain signal matching, cepstral based pitch frequency analysis, combination methods, physical pitch measurements using optical or acoustic signals. However the pitch is measured, the pitch measurements associated with some corpus of each speaker are averaged to create some value.

The second speaker's pitch is adjusted to match the first speaker pitch at step 230. At Step 240 the invention determines how much to move the second speaker's formants to match the formants of the first speaker. The formants of the second speaker's speech are moved frame by frame to match the function of the first speaker's formants at Step 250. At Step 260, the signal is reconstructed frame by frame. The entire signal is reconstructed at step 270.

Figure 3:
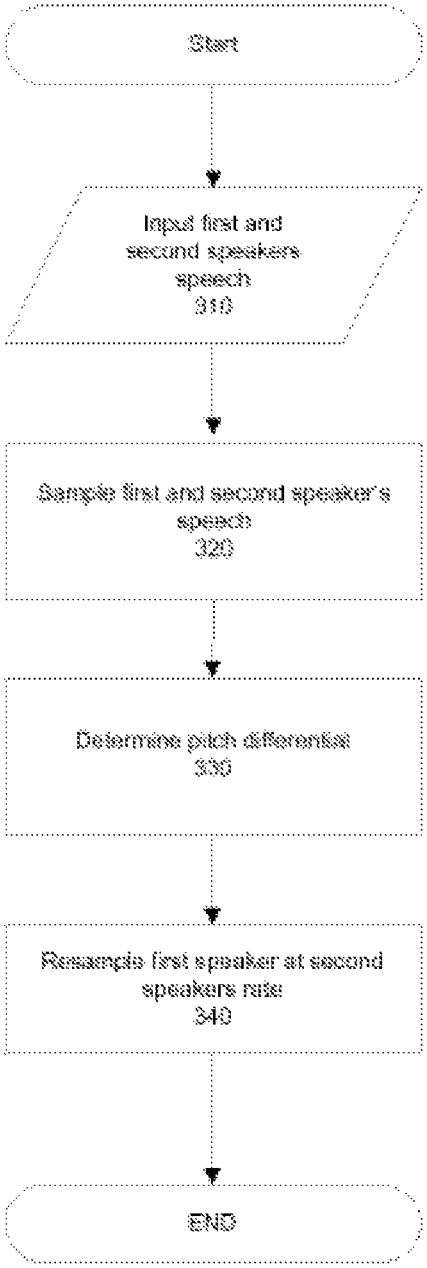
FIG. 3 illustrates changing the pitch of a first speakers voice to match the pitch of a second speakers voice.

FIG. 3 illustrates a flow diagram of matching the pitch of the first speaker to the pitch of the second speaker. The pitch of the first speaker is adjusted to match the pitch of the second speaker using a band-limited resampling algorithm, but without knowing the time value of the pitch at each time. At Step 310, the invention obtains the speech from a first and second speaker. Each speaker's speech is sampled at step 320. At Step 330, the invention determines the pitch differential between the first speaker's speech and the second speaker's speech. The resampling frequency is adjusted so that the average pitch of the first speaker when computed on the resampled signal, but assuming that the sampling rate is that of the second signal from the second speaker, now matches the average pitch of the second speaker.

Figure 4:
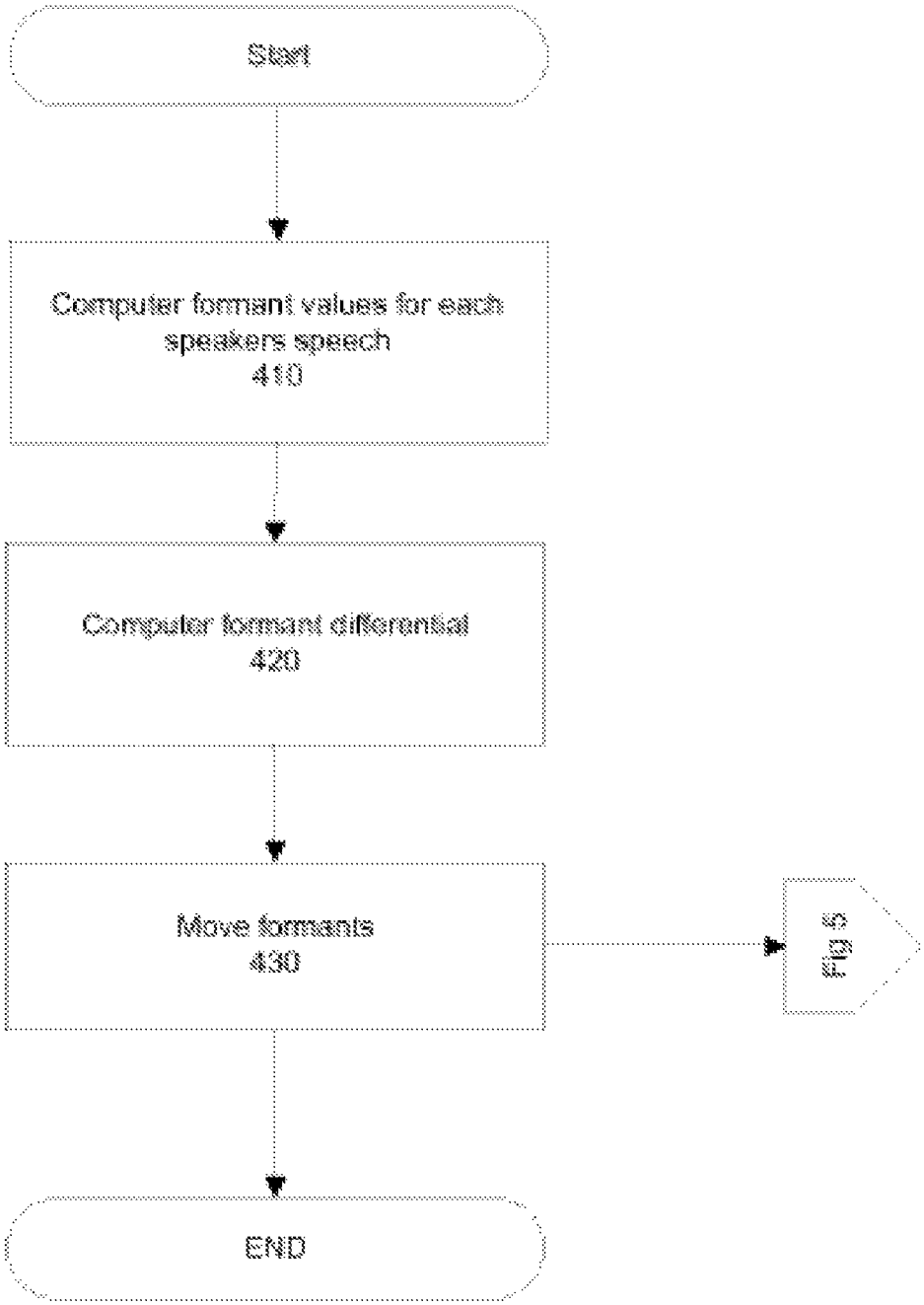
FIG. 4 illustrates a flow diagram showing matching the formants of a first speaker's voice to a second speakers voice.
Figure 5:
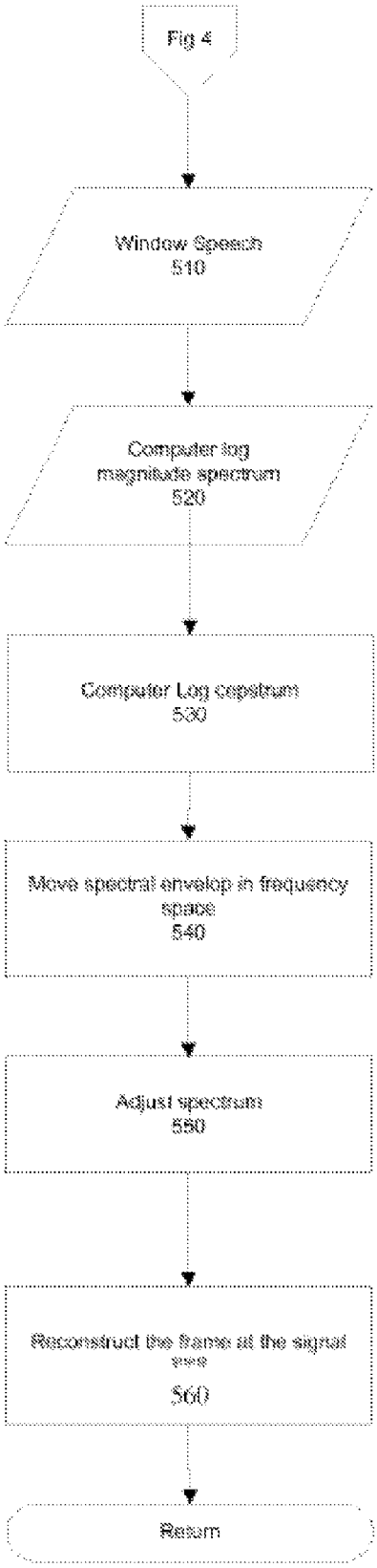
FIG. 5 illustrates a flow diagram of the invention.

FIG. 4 illustrates a flow diagram to make the formant locations match. At Step 410 the invention computes the average formant value for the first and second speaker. At Step 420, the invention computes the amount that the first speakers formants must be moved to match the second speakers formants. This differential is merely the ration of the average values the second speaker's formant divided by the average value of the first speaker's formants. At Step 430, the invention moves the formants. FIG. 5 illustrates how the formants in the first speakers speech are moved. At Step 510, the invention windows the speech. At Step 520, the invention computes the log magnitude spectrum, remembering the phase at each frequency, at Step 530, the invention computes the log magnitude cepstrum at each frequency, remembering the phase. At Step 540, the spectral envelope in frequency space is moved. For each frequency $\omega$, we know $A(w)$. For each frequency $\omega$, we can find $A'(w)$ (which would have been seen if the first speaker was actually the second speaker) by 1. find $w'=w*$the ratio of the speakers formants.
2. $B(w')=A'(w)$ Having computed $A'$ at each point w, we can compute a $gain(w)=A(w)-A'(w)$. At Step 550, the invention adjusts the spectrum for this frame by the gain at each frequency. This moves the formants (or any other spectral feature) by the ration of the speaker's formants. At Step 560, the invention reconstructs the frame of signal by reinserting the phase at each frequency and doing an inverse transform. This can be done in either the log cepstral domain or in the power domain using an appropriate arithmetic operation. At Step 560, the inventions reconstruct the entire signal using overlap-and-add reconstruction, as is normal in zero-phase filtering operations.

Figure 6:
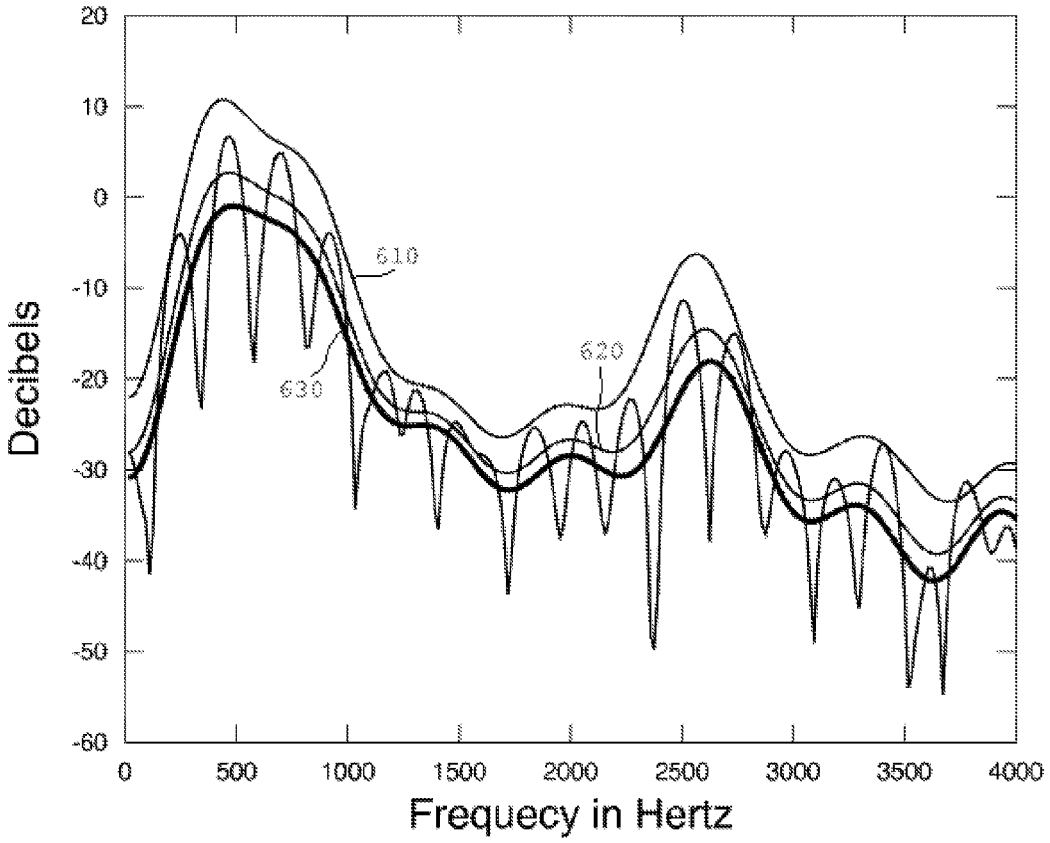
FIG. 6 illustrates a spectral representation of the invention.

The remaining detail is the computation of the envelope of a log spectrum of a frame. An example of this computation may be understood by examining FIG. 6 a as follows:

In FIG. 6, Log Spectrum 610 is the log magnitude spectrum of a frame of speech. The cepstrally smoothed average is line 620, computed by: Taking the Fourier transform of the Log Spectrum 610; Setting all but the 16 lowest frequency cepstral components to zero; taking an inverse Fourier transform of the cepstrum. The number of non-zero cepstral parameters may be chosen but is generally in the range 10 to 30.

This "cepstrally smoothed" value is used in many other algorithms to represent the spectrum, but it is not what a person hears. Rather, the person hears the energy at the peaks of the spectrum, which we refer to as the "envelope" of the spectrum 630. The envelope is computed as follows: Compute an auxiliary spectrum consisting of, at each frequency, the maximum of the spectrum and the "cepstrally smoothed" spectrum; Cepstrally smooth that auxiliary spectrum as we did above.

Finally, compute the envelope as, at each frequency, the value of the smoothed log spectrum plus the difference of the smoothed auxiliary spectrum and the smoothed log spectrum times a constant (empirically determined as 4, but may be between 3 and 4).

Following this algorithm, it is possible to move pitch and formants independently, simultaneously, and efficiently, changing speaker A to mimic speaker B. However, the pitch change described here changes the length of the speech signal by a proportion that is the proportion of pitch change. This may be ignored, or it may be corrected by using some standard procedures, all of which are well known to someone of ordinary skills in the art.

I claim:

1. A method for making the speech of a first human speaker sound like the speech of a second human speaker, the method comprising:

obtaining first speech from a first speaker;

obtaining second speech from a second speaker;

sampling the first speech and the second speech;

determining average first pitch of the first speech and average second pitch of the second speech;

setting the first average pitch of the first speech to be equal to the second average pitch of the second speech;

determining a first spectral envelope of the first speech and a second spectral envelope of the second speech;

warping the first spectral envelope of the first speech to be statistically the same as the second spectral envelope of the second speech, by adjusting a gain at each frequency point of the first speech by a difference between the second spectral envelope of the second speech and the first spectral envelope of the first speech, wherein the difference comprises a ratio of average values of formants of the first speech to average values of formants of the second speech; and reconstructing the warped first speech, based on results of the warping and the first average pitch of the first speech.

2. The method of claim 1, further comprising:

computing a log spectrum of the first speech;

computing a smooth version of the log spectrum of the first speech using cepstral smoothing;

computing a clipped version of a log magnitude spectrum of the first speech;

cepstral smoothing the clipped version of the log magnitude spectrum of the first speech; and computing the spectral envelope of the first speech as a value of a product of a first cepstrally smooth function plus a difference between a second cepstrally smoothed function and the first cepstrally smoothed function times an empirically determined constant.

3. The method of claim 2, where the empirically determined constant is between three and four.

4. The method of claim 1, wherein the warping of the spectral envelope of the first speech comprises applying a monotonically increasing warping function of frequency to the spectral envelope of the first speech.

* * * * *